US006155908A

United States Patent [19]

Hakomori

[11] Patent Number: 6,155,908

[45] Date of Patent: Dec. 5, 2000

[54] WORK-LOADING METHOD AND SURFACE-GRINDING APPARATUS WITH WORK POSITION DEVIATION-ADJUSTING MECHANISM

[76] Inventor: Shunji Hakomori, 2647, Hayakawa, Ayase-shi, Japan

[21] Appl. No.: 09/271,944

[22] Filed: Mar. 18, 1999

[30] Foreign Application Priority Data

Mar. 31, 1998 [JP] Japan ..... 10-103550

[51] Int. Cl.[7] ..... B24B 1/00; B24B 47/02

[52] U.S. Cl. ..... 451/28; 451/331; 451/334

[58] Field of Search ..... 451/282, 287, 451/288, 289, 331, 334, 910, 366

[56] References Cited

U.S. PATENT DOCUMENTS

| | | | |
|---|---|---|---|
| 3,488,893 | 1/1970 | Zocca | 451/331 |
| 4,148,161 | 4/1979 | McCandless et al. | 451/334 |
| 4,434,583 | 3/1984 | Burgess, Jr. | 451/334 |

*Primary Examiner*—Rodney A. Butler
*Attorney, Agent, or Firm*—Snell & Wilmer, L.L.P.

[57] ABSTRACT

There are provided with a carrier having a work-holding hole in which a work is fitted and held, a surface plate for grinding the work held on the carrier, and exciter for exciting the carrier to adjust a position of the work deviated from the work-holding hole. Exciting the carrier by the exciter causes a position of the work, deviated from the work-holding hole, to be adjusted, thereby causing the work to be fitted in the work-holding hole.

8 Claims, 2 Drawing Sheets

WORK-LOADING METHOD AND SURFACE-GRINDING APPARATUS WITH WORK POSITION DEVIATION-ADJUSTING MECHANISM

BACKGROUND OF THE INVENTION

1. Field of the Invention

The present invention relates to a work-loading method and a surface-grinding apparatus with a work position deviation-adjusting mechanism, which is capable of surely loading a disk-like work, such as a semiconductor wafer and a magnetic disk substrate, in a work-holding hole of a carrier.

2. Prior Art

Surface-grinding apparatuses, such as lapping machines and polishing machines, generally comprise a sun gear, an internal gear, and an upper and a lower surface plate, and is configured to grind both surfaces of a work held in a work-holding hole of a carrier which engages the gears to undergo an epicyclical movement.

The above-mentioned surface-grinding apparatuses generally comprises a clearance (backlash) between the carrier and each of the sun and the internal gear. A bore of the work-holding hole is 1 to 1.5 mm larger than the diameter of the work in order for an automatic machine to surely load the work. To this end, if the clearance between the work-holding hole and the work is too large, the work is shook in the work-holding hole during grinding, and an outer periphery of the work is apt to be lapped or chipped by the carrier.

Therefore, according to the kinds of the work, there may be used a carrier having a smaller than usual work-holding hole, for example, a carrier in which a bore of the work-holding hole is 0.4 to 0.5 mm larger than the diameter of the work. The smaller the difference between the bore of the work-holding hole and the diameter of the work, the more difficult it is to automatically load the work. This makes it easy for the work loading to fail, e.g. for the work to come off the work-holding hole.

SUMMARY OF THE INVENTION

It is therefore an object of the invention to provide a work-loading method and a surface-grinding apparatus with a work position deviation-adjusting mechanism, which, if a work is supplied to a work-holding hole of a carrier with a position of the work deviated from the work-holding hole, adjusts the position of the work so that the entire work lies in the work-holding hole.

In order to attain the above object, the present invention provides a work-loading method characterized by comprising the steps of supplying a work in a work-holding hole of a carrier located on a surface plate, exciting the carrier to adjust a position of the work deviated from the work-holding hole, to thereby fit the work in the work-holding hole.

According to the above method, a simple method of exciting the carrier causes the work, which comes off the work-holding hole, to be displaced, thereby causing the work to be surely fitted in the work-holding hole. Therefore, there can be used a carrier having small clearance between the work-holding hole and the work.

Also, in order to carry out the above method, the present invention provides a surface-grinding apparatus with a work position deviation-adjusting mechanism, characterized by comprising a carrier having a work-holding hole in which a work is fitted and held, a surface plate for grinding the work held on the carrier, and exciting means for exciting the carrier to adjust a position of the work deviated from the work-holding hole.

In a preferred embodiment of the present invention, the carrier engages with a sun gear and an internal gear through clearances, and then the carrier is vibrated within the play.

In another preferred embodiment of the present invention, the exciting means has a vibrating head, abutted to the carrier to vibrate, at a leading end of a supporting arm which is displaced between an operating position and a waiting position, and the vibrating head has a soft contact surface member having a large coefficient of friction, at a surface thereof abutted to the carrier.

Preferably, the vibrating means has a vibrating head, and the vibrating head vibrates in at least one of an up-and-down direction or a lateral direction.

Further objects and advantages of the invention will be apparent from the following description of the preferred embodiment of the present invention as illustrated in the accompanying drawings.

DETAILED DESCRIPTION OF THE EMBODIMENT

Figure 1:
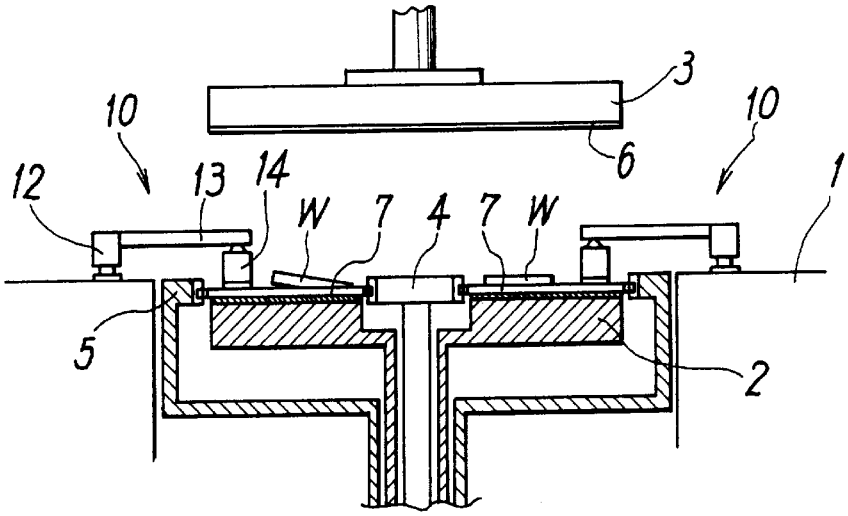
FIG. 1 is a sectional view of a surface-grinding apparatus according to an embodiment of the present invention.

There is shown in FIG. 1 a surface-grinding apparatus according to an embodiment of the present invention. In FIG. 1, reference numeral 1 designates a base body, 2 a lower surface plate rotatably disposed on the base body 1, 3 an upper surface plate supported by an air cylinder (not shown), which is configured to rotate and vertically move the upper surface plate 3, 4 a sun gear rotatably disposed on a center portion of the lower surface plate 2, and 5 an internal gear rotatably disposed around the lower surface plate 2. The surface plates 2, 3 and the both gears 4, 5 are connected with a motor (not shown) through a transmission mechanism to be rotation-driven at a predetermined speed in a predetermined direction.

Figure 2:
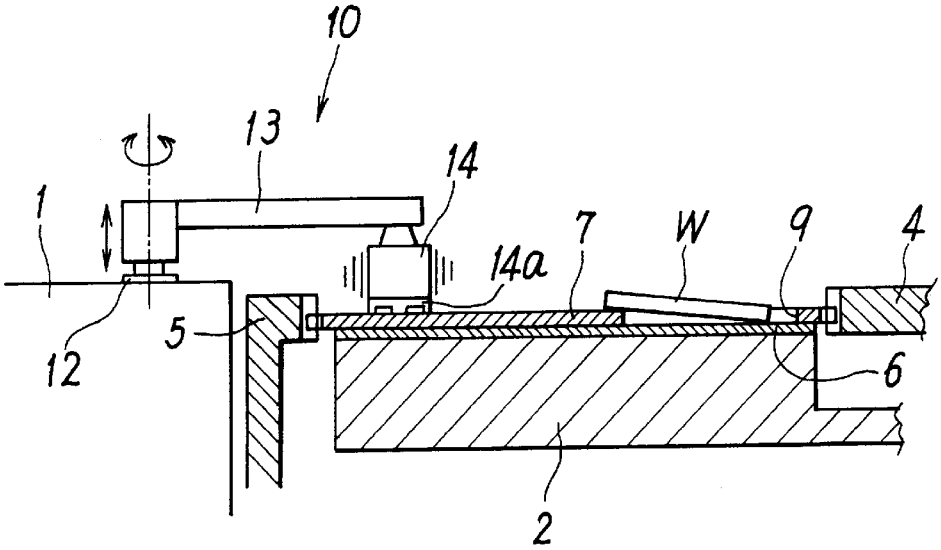
FIG. 2 is an enlarged view of a main part of the embodiment shown in FIG. 1.
Figure 3:
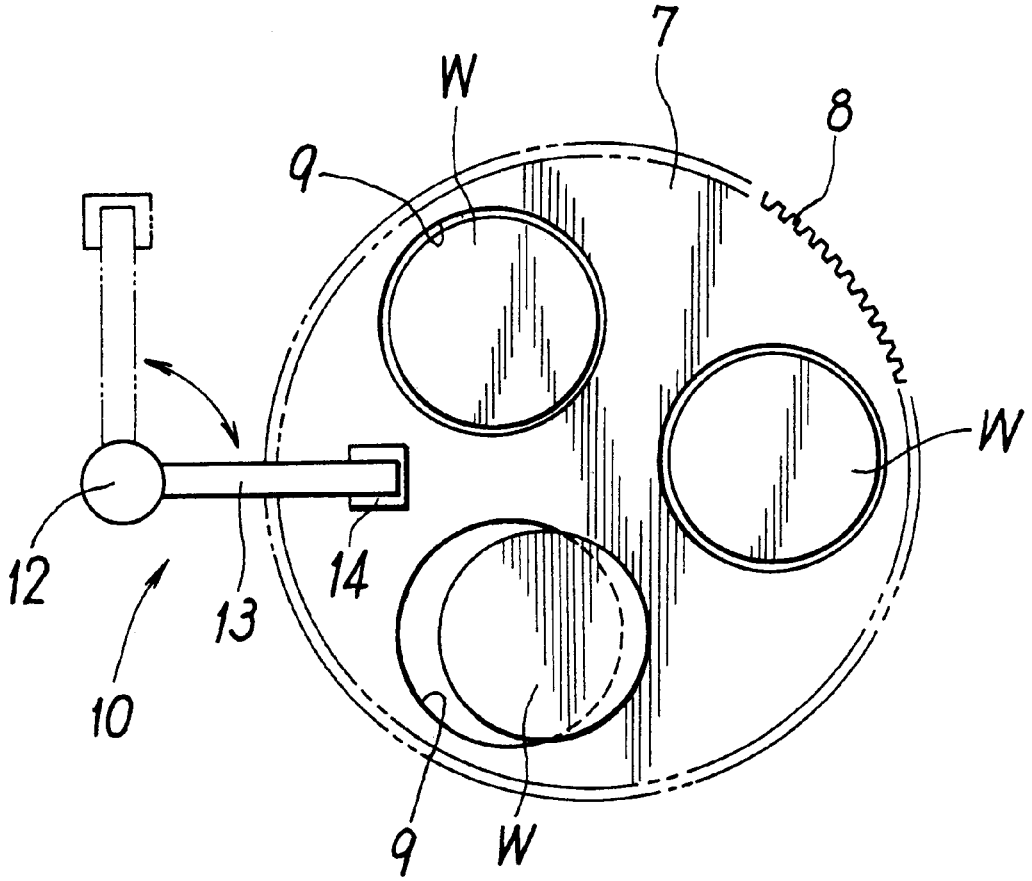
FIG. 3 is a enlarged plan view of a main part of the embodiment shown in FIG. 1.

On the lower surface plate 2 is mounted a carrier 7 which is configured to move epicyclically. That is, as shown in FIGS. 2 and 3, a periphery gear portion 8 of the carrier 7 is engaged with the both gears 4, 5; therefor, the rotation of the both gears 4, 5 causes the carrier 7 to rotate on its own axis and at the same time rotate around the sun gear 4. The carrier 7 has, at regular equi-angular distances, one or more circular work-holding holes 9 each for holding a disk-like work W to be ground. On surfaces of the upper and the lower surface plates 2, 3 are pasted grinding pads 6, respectively, which grind the work W held in the work-holding hole 9.

A plurality of exciting means 10 are disposed at positions adjacent to the lower surface plate 2 of the base body 1 so as to correspond to the respective work-holding holes 9. The exciting means 10, after the works W are supplied in the work-holding holes 9 of the carrier 7, are for exciting the carrier 7 to adjust a position of the works W deviated from the work-holding holes 9, to thereby position the works W in the work-holding holes 9. The exciting means 10 is constructed as follows:

That is, the exciting means 10 has a supporting portion 12 including a driving means such as an air cylinder and a motor, a supporting arm 13 supported on the supporting portion 12 and which is configured to be rotated and moved vertically by supporting portion 12, and is displaced between an operating position and a waiting position, and a vibrating head 14 attached to a leading end of the supporting arm 13. Then, the vibrating head 14 is abutted to an upper surface of the carrier 7 to thereby vibrate the carrier 7. To lower surface of the vibrating head 14 is attached a contact surface member 14*a* made of a soft material having a large coefficient of friction, such as a silicone rubber and a synthetic resin, and then is constructed so as to contact to the carrier 7 through the contact surface 14*a*.

The vibrating head 14 has a built-in vibration generating mechanism for electrically, magnetically or mechanically generating a vibration which slightly vibrates the whole vibrating head 14 or the contact surface member 14*a* in at least one of an up-and-down direction and a lateral direction. The amplitude of the lateral vibration is within the clearance between the carrier 7 and the sun and the internal gear 4, 5.

The exciting means 10 is constructed in such a manner that when the works W are supplied in the work-holding holes 9 of the carrier 7 by the loading means, the supporting arm 13 turns from the waiting position shown by the chain line in FIG. 3 to the operating position shown by the actual line, and then the vibrating head 14 is abutted to the upper surface of the carrier 7 to thereby vibrate the carrier 7. The vibration of the carrier 7 causes the work W, which rides on a hole edge of the work-holding hole 9 with an inclined condition, to be gradually slidably moved toward the work-holding hole 9, which enables a position of the work W to be adjusted. This causes the work W to be accurately positioned in the work-holding hole 9.

In this way, the position deviation of the work W is adjusted, and then the upper surface plate 3 goes down. The rotation of the sun and the internal gear 4, 5 causes the upper and the lower surface plate 2, 3 to grind the works W which are held in the work-holding holes 9 of the carrier 7 undergoing the epicyclical movement around the sun gear 4.

According to the above-mentioned invention, a simple method of exciting the carrier causes a position of the work, supplied to the work-holding hole of the carrier while being deviated, to be adjusted, thereby causing the work to be surely positioned in the work-holding hole with the position of the work adjusted.

What is claimed is:

1. A surface-grinding apparatus with a workpiece position deviation-adjusting mechanism comprising:

a carrier having at least one hole for receiving a workpiece;

a surface plate for grinding said workpiece; and exciting means for exciting said carrier to adjust a position of said workpiece deviated from said hole, said exciting means comprising:

a vibrating head disposed adjacent said carrier and configured to vibrate said carrier.

2. A surface-grinding apparatus in accordance with claim 1 wherein said apparatus further comprises:

a sun gear; and an internal gear concentrically surrounding said sun gear, wherein said carrier is disposed between said sun gear and said internal gear and is configured to vibrate between said sun gear and said internal gear by said head.

3. A surface-grinding apparatus in accordance with claim 1 wherein said exciting means further comprises a supporting arm connected to said vibrating head and configured to move said vibrating head between an operating position and a waiting position.

4. A surface-grinding apparatus in accordance with claim 1 wherein said vibrating head comprises a soft contact surface member configured to contact said carrier.

5. A surface-grinding apparatus in accordance with claim 2 wherein said exciting means further comprises a support arm connected to said head and configured to move said vibrating head between an operating position and a waiting position.

6. A surface-grinding apparatus in accordance with claim 2 wherein said head comprises a soft contact surface member configured to contact said carrier.

7. A surface-grinding apparatus in accordance with claim 4 wherein said soft contact surface member has a large coefficient of friction.

8. A surface-grinding apparatus in accordance with claim 6 wherein said soft contact surface member has a large coefficient of friction.

* * * * *